US006951241B1

(12) United States Patent
Gatley

(10) Patent No.: US 6,951,241 B1
(45) **Date of Patent: *Oct. 4, 2005**

(54) METHOD FOR COOLING A MOTOR IN A BLOWER ASSEMBLY FOR A FURNANCE

(75) Inventor: William S. Gatley, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/597,448

(22) Filed: Jun. 20, 2000

Related U.S. Application Data

(60) Provisional application No. 60/140,144, filed on Jun. 21, 1999.

(51) Int. Cl.[7] ..... F24H 3/00

(52) U.S. Cl. ..... 165/47; 310/89; 126/516; 126/110 A; 415/214.1

(58) Field of Search ..... 165/47; 310/89; 415/214.1, 3; 110/162; 417/53, 366–372, 417/371, 423.1, 423.14; 126/104 A, 110 A, 126/312, 112, 516, 517, 521, 110 R; 122/17

(56) References Cited

U.S. PATENT DOCUMENTS 1,076,142 A * 10/1913 Mellin ..... 110/162
2,864,359 A * 12/1958 Vaughn ..... 126/104 A
3,782,303 A * 1/1974 Pfister et al. ..... 126/312 X
4,750,433 A * 6/1988 Guzorek ..... 110/162
4,759,272 A * 7/1988 Zaniewski ..... 110/162 X
4,762,472 A * 8/1988 King ..... 417/366
4,767,285 A * 8/1988 Jyoraku et al. ..... 417/366
4,840,222 A * 6/1989 Lakin et al. ..... 165/47
4,893,995 A * 1/1990 Hufstader ..... 417/423.14 X
5,070,772 A * 12/1991 Guzorek ..... 110/162 X
5,110,266 A * 5/1992 Toyoshima et al. . 417/423.14 X
5,352,099 A * 10/1994 Anstine et al. ..... 417/366
5,375,651 A * 12/1994 Colwell ..... 165/47
5,795,220 A * 8/1998 Core
5,814,908 A * 9/1998 Muszynski ..... 417/366 X
5,816,781 A * 10/1998 Bercot et al. ..... 417/371
5,839,374 A * 11/1998 Conner et al. ..... 110/162
5,954,476 A * 9/1999 Stewart et al.
6,059,541 A * 5/2000 Beckey et al. ..... 417/423.14 X
6,074,181 A * 6/2000 James ..... 417/366
6,112,741 A * 9/2000 Stickford et al. ..... 126/312 X
6,116,864 A * 9/2000 Veser et al. ..... 417/366 X
6,231,311 B1 * 5/2001 Gatley et al. ..... 417/53
6,296,478 B1 * 10/2001 Gatley, Jr. ..... 126/104 A
6,318,358 B1 * 11/2001 Gatley, Jr. ..... 126/110 R
6,352,431 B1 * 3/2002 Gatley, Jr. ..... 126/104 A X
6,368,081 B1 * 4/2002 Matsumoto ..... 417/423.1 X
6,386,123 B1 * 5/2002 Gatley, Jr. ..... 110/162
6,386,843 B1 * 5/2002 Umeda et al. ..... 417/423.14
6,398,512 B2 * 6/2002 Stewart ..... 417/53
6,406,275 B1 * 6/2002 Hoehn ..... 417/366
6,439,861 B1 * 8/2002 Shieh ..... 417/371

(Continued)

*Primary Examiner*—Ljiljana Ciric
(74) *Attorney, Agent, or Firm*—Andrus, Sceales, Starke & Sawall, LLP

(57) ABSTRACT

A method of cooling the bearings of a motor in a motor housing for a furnace assembly is disclosed comprising an aperture in the motor housing whereby air is brought into the motor housing and drawn around the motor via an impeller into the impeller housing thereby eliminating the need of a separately attached fan to cool the motor or motor bearings. The impeller pulls the air from the motor housing into the impeller housing or blower via an inlet port in the impeller housing and apertures in the back plate of the impeller and out an exhaust port situated in the impeller housing.

8 Claims, 2 Drawing Sheets

U.S. PATENT DOCUMENTS 6,461,124 B1 * 10/2002 Morelli ..... 417/423.14 X
6,474,981 B1 * 11/2002 Morgan ..... 417/423.14 X
6,488,475 B2 * 12/2002 Murata et al. ..... 417/423.14 X
6,602,058 B1 * 8/2003 Stewart ..... 417/53
2002/0038794 A1 * 11/2001 Stewart ..... 417/53
2002/0014233 A1 * 2/2002 Gatley, Jr. et al. ..... 126/110 R

* cited by examiner

METHOD FOR COOLING A MOTOR IN A BLOWER ASSEMBLY FOR A FURNANCE

CROSS-REFERENCE TO RELATED APPLICATIONS

A claim of benefit is made to U.S. Provision Application Ser. No. 60/140,144 filed Jun. 21, 1999, the contents of which are incorporated herein by reference. This application is a continuation of the provisional application Ser. No. 60/140,144 entitled, "80+ Blower and Furnace Venting Method" and filed Jun. 21, 1999, the teachings of which are incorporated herein by reference.

STATEMENT OF GOVERNMENT INTEREST

Not Applicable.

BACKGROUND OF THE INVENTION (1) Field of the Invention

This invention relates generally to a method for cooling a motor in a blower assembly for a furnace. More particularly, the present invention relates to a method of cooling an electric motor without an auxiliary fan in a blower assembly.

(2) Description of Related Art

Typically, many gas-furnaces use induced draft blower assemblies to control flue gas by removing the burnt by-products. These blowers are designed to produce a certain amount of airflow. The motor's shaft extends radially into the blower's housing where an impeller is attached to the motor shaft. The blower housing typically has one inlet and one outlet. Combustion gases are drawn into the housing by the rotating impeller that expels the gases through the outlet into a flue or similar avenue of exit.

With respect to motor cooling, the gases that are forcibly moved through the housing by the impeller do not come into contact with the motor. Thus, blower activity does not in any way contribute to the cooling of the motor.

As is known in the state of the art for conventional motor and furnace assemblies, auxiliary fans are provided on the rotating shaft of a blower motor to draw air into the motor housing to cool the motor. The furnace electronics are located in the vestibule area of the motor casing where the air temperature can often reach 150°. The inevitable exposure of the electronics to the vestibule heat shortens the working life of the electronics. Typically vents are provided in the motor housing to allow for the entry and exit of cooling air.

There are three notable drawbacks associated with the presence and operation of fans in a blower motor assembly. First, the fan inevitably creates drag on the operating motor and reduces motor efficiency with respect to the task of drawing in and expelling exhaust gases from an operating furnace. Second, the fan inevitably generates unwanted noise. Third, the presence of one or more fans increases the overall length of the blower motor assembly. In an effort to solve these numerous related problems, a method for venting the air in a furnace or blower housing assembly has now been achieved that optimizes the intake of combustion air and the expulsion of exhaust gases while providing a "cool-to-the-touch" blower housing.

It is an object of the present invention to provide a method for cooling the motor that eliminates the need for an auxiliary fan. Another object of the invention is to reduce noise levels produced by a blower by eliminating the auxiliary fan. A further object of the invention is to reduce overall blower motor height to allow for more streamlined furnaces. A yet further object of the invention is to provide a means of eliminating heat sources near the electronics in the vestibule portion of a furnace to which the blower is attached. These and other objects are accomplished from the following described blower.

SUMMARY OF THE INVENTION

This invention relates to a method of cooling a motor in a blower assembly that thereby eliminates the need to have an auxiliary fan to cool the motor.

According to the invention the assembly blower or motor casing has at least one hole or aperture located anywhere on the motor case to allow for the flow of air into the motor case. The combination of the aperture on the motor case and impeller back plate aperture allows for external air to be drawn into the blower over the motor and into the impeller portion of the blower housing and out an exhaust port situated in the blower housing.

The new method eliminates the need for an auxiliary fan to cool the motor, thereby, reducing the overall length of the assembly. This method not only provides a motor case that is self cooling but also provides the additional benefit of being cool to the touch. Finally, this method provides for the reduction of noise by the elimination of the fan.

These and other objects and features of the present invention will be apparent from a review of the drawings and a reading of the following detailed description of the invention.

DETAILED DESCRIPTION OF THE INVENTION

Figure 1:
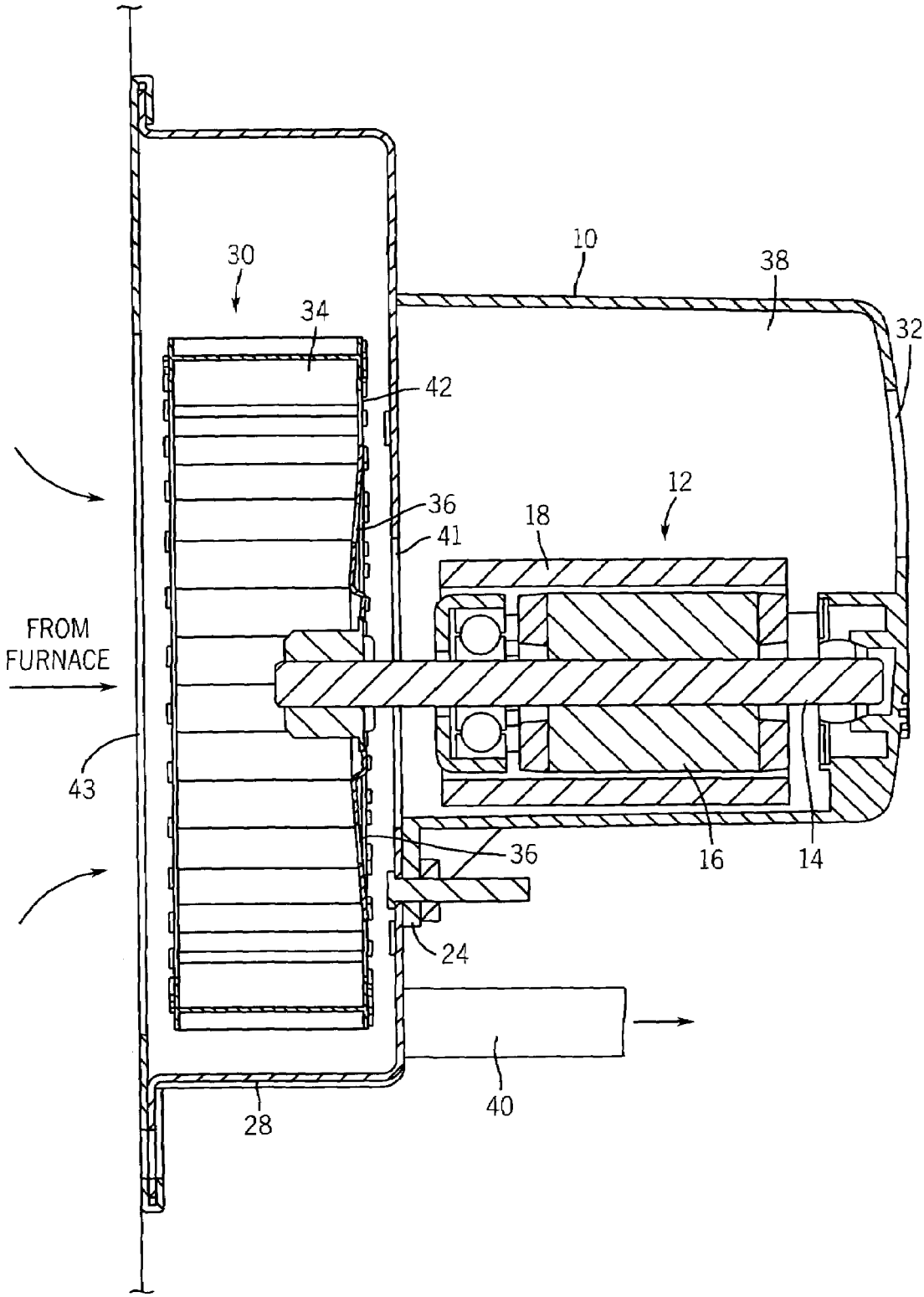
FIG. 1 is a perspective view of a traditional blower assembly with a motor housing according to one embodiment of the invention.
Figure 2:
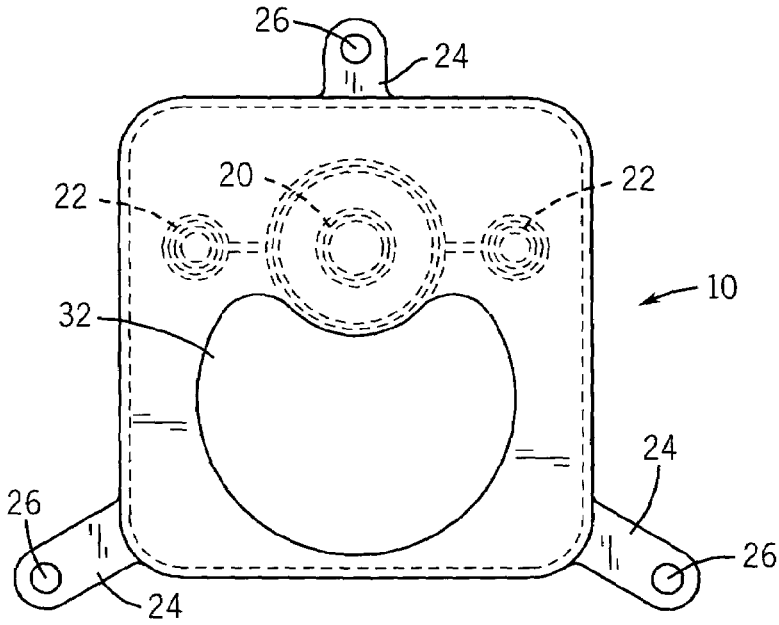
FIG. 2 is an end view of a motor housing 10 as shown in FIG. 1.
Figure 3:
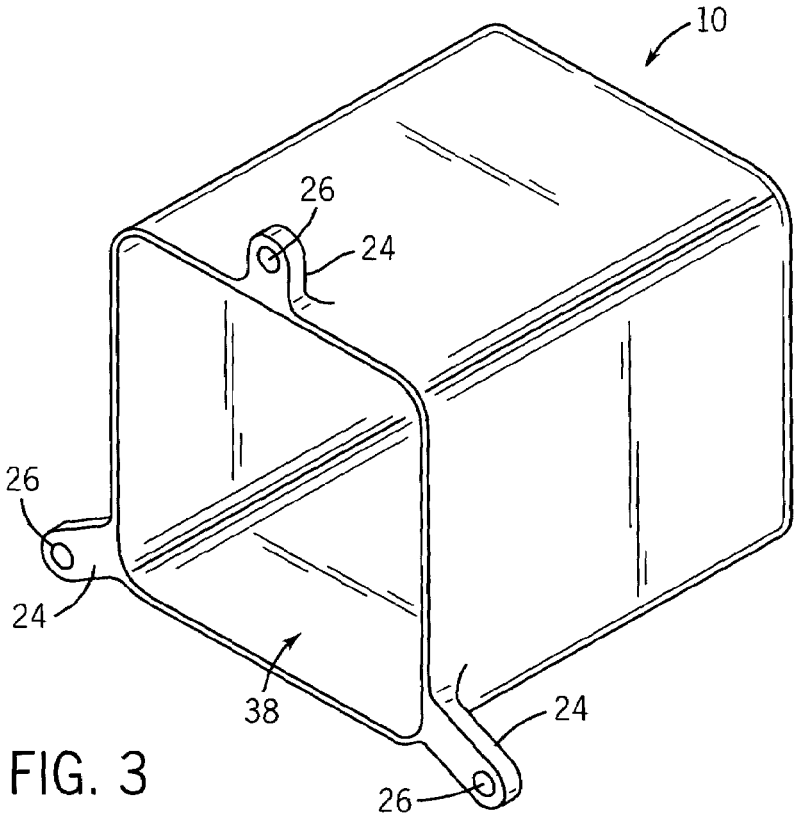
FIG. 3 is a perspective view of a motor housing 10 as shown in FIG. 1.

Referring to FIGS. 1–3, a method for cooling a motor in a blower housing assembly for furnaces according to one embodiment of the invention is shown. A motor cover or housing 10 is configured to encompass a motor 12 which comprises a shaft 14, rotor 16 and stator 18. Motor cover 10 has portions that define a shaft bushing 20 and mechanical fastener bores 22 for securing motor 12 to motor cover 10. Motor cover 10 has flanges 24 each of which has portions defining a fastener bore 26 for securing motor cover 10 to an impeller housing 28 which is configured to encompass an impeller 30 which is attached to shaft 14. Impeller 30 is situated in impeller housing 28 such that impeller 30 can freely rotate within said impeller housing 28.

Motor cover 10 has at least one hole or aperture 32 located anywhere on motor cover 10 for drawing in air to cool the bearings (not shown) of the motor 12 in the motor cover 10. In an alternate embodiment, vent aperture 32 can be formed as a plurality of vent slots in other shapes (not shown) or as a combination of apertures.

Impeller 30 has a plurality of fins 34 which provide surfaces for directing incoming air from motor chamber 38 or exhaust gases from an attached furnace. The incoming air from the motor 12 flows through an inlet port 41 between the motor housing 10 and the impeller housing 28. The air then flows through at least one any size hole or aperture 36 located on the back plate 42 of the impeller 30 from the motor case 10 by rotation of the impeller 30.

The method of venting the air in furnaces according to the foregoing description results in a blower design that eliminates the need for an auxiliary fan (not shown) attached to shaft 14. In this method there is at least one hole or aperture 32 situated anywhere in a motor case or housing 10 that allows for air to enter the housing 10 to cool the bearings (not shown) of the motor 12 and the motor 12 itself in the motor case 10. The warm air flows across and around the motor 2 in the direction of the impeller housing 28 and through an inlet port 41 in the impeller housing 28. The air then flows through at least one any size hole or aperture 36 located on the back plate 42 of the impeller 30 from the motor case 10 by rotation of the impeller 30. The exhaust air from the furnace is drawn in through an exhaust gas inlet 43 by the impeller 30 and is directed out of the outlet pipe 40 connected to the impeller housing 28.

Elimination of an auxiliary fan allows for the reduction in the overall height for the blower housing. This, in turn, allows for a similar reduction in height of a furnace. Coupled with this beneficial effect is the elimination of some of the noise that is inevitably produced by the blower via fan operation. Also maximized is the elimination of the heat source near the furnace electronics that are at least partially contained in the furnace vestibule.

It is further possible to eliminate much of the heat that is generated in the vestibule of a furnace. Temperatures which typically reach 150° F. an be reduced to 90° F. by using the novel venting method. The blower can be sealed off to the furnace for fresh air intake. Optionally, the blower can be sealed off to the furnace door to allow for the total sealing of the inducer compartment to maximize blower efficiency. Such a configuration maximizes the drawing of motor heat into the impeller chamber and out the outlet pipe 40 which is in fluid communication with the impeller housing 28. Also maximized is the elimination of the heat source near the furnace electronics which are at least partially contained in the vestibule.

Numerous alternatives and embodiments exist for the invention such as modifications of the motor housing geometric configuration, integral versus modular motor cover and impeller housing, single large vent aperture versus a plurality of vent slots in the motor cover.

It is to be understood that the present invention is by no means limited to the particular constructions herein disclosed and/or shown in the drawings, but also comprises any modifications or equivalents within the scope of the claims.

What is claimed is:

1. A method for eliminating the use of an auxiliary cooling fan and for cooling a motor of a blower assembly used to expel exhaust gases from a furnace, the blower assembly having a motor housing for enclosing the motor and an impeller housing fixed to the motor housing that receives an impeller mounted to a motor shaft of the motor, the method comprising the steps of:

forming at least one vent aperture in the motor housing at an outer end of the motor housing spaced from the impeller housing such that cooling air can enter the motor housing through the at least one vent aperture and pass over the motor;

closely mounting the motor housing to the impeller housing such that cooling air can enter the motor housing only through the at least one vent aperture;

forming an inlet port between the motor housing and the impeller housing such that cooling air can enter the impeller housing directly from the motor housing only through the inlet port;

forming at least one aperture in a back plate of the impeller such that cooling air can pass through the back plate of the impeller; and rotating the impeller to both draw cooling air into the motor housing through the vent aperture formed at the outer end of the motor housing such that the cooling air is drawn over the motor and into the impeller housing to cool the motor and to draw exhaust gases into the impeller housing from the furnace through an exhaust gas inlet formed in the impeller housing, wherein the rotating impeller expels both the cooling air and the exhaust gas from the impeller housing through an outlet pipe.

2. The method of claim 1 wherein the motor housing is secured to the impeller housing.

3. The method of claim 1 wherein the motor shaft passes through the inlet opening between the motor chamber and the impeller chamber, the inlet opening being sized substantially larger than the motor shaft to permit the desired flow of cooling air through the inlet opening to cool the motor.

4. A furnace blower assembly for expelling exhaust gases from a furnace, the blower assembly being devoid of an auxiliary cooling fan for creating a flow of cooling air, the blower assembly comprising:

a motor having a motor shaft;

a motor housing configured to receive and enclose the motor, the motor housing including at least one vent aperture formed at an outer end of the motor housing for allowing external cooling air to enter the motor housing only through the vent aperture;

an impeller housing closely mounted to the motor housing, the impeller housing including an inlet port for providing fluid communication between the impeller housing and the motor housing, wherein the external cooling air can enter the motor housing only through the vent aperture when the motor housing is closely mounted to the impeller housing; and an impeller enclosed within the impeller housing and mounted to the motor shaft for rotation with the motor shaft, the impeller having a back plate and a plurality of fins, wherein the back plate faces the inlet port and includes a plurality of apertures, wherein the blower assembly includes only one impeller such that rotation of the single impeller draws cooling air into the motor housing only through the vent aperture such that the cooling air flows over the motor, through the inlet opening and into the impeller housing from the motor housing for cooling the motor and draws the exhaust gases from the furnace into the impeller chamber through an exhaust gas inlet formed in the impeller housing.

5. The furnace blower assembly of claim 4 wherein the motor housing is closely connected to the impeller housing such that cooling air can enter the motor housing through only the vent aperture formed in the motor housing.

6. The furnace blower assembly of claim 4 wherein the motor shaft extends through the inlet port and the inlet port is sized substantially larger than the motor shaft to permit the desired flow of cooling air through the inlet opening to cool the motor.

7. The furnace blower assembly of claim 4 wherein the apertures formed in the back plate of the impeller allow the cooling air to pass through the back plate.

8. The furnace blower assembly of claim 4 wherein the impeller housing includes an outlet pipe such that rotation of the impeller expels the exhaust gases and the cooling air from the impeller housing through the outlet pipe.

* * * * *